US005587732A

United States Patent [19]

Kokubo

[11] Patent Number: 5,587,732

[45] Date of Patent: Dec. 24, 1996

[54] COLOR THERMAL PRINTING METHOD AND APPARATUS

[75] Inventor: Hideyuki Kokubo, Saitama, Japan

[73] Assignee: Fuji Photo Film Col., Ltd., Kanagawa, Japan

[21] Appl. No.: 145,107

[22] Filed: Nov. 3, 1993

[30] Foreign Application Priority Data

Nov. 4, 1992 [JP] Japan ..... 4-295444

[51] Int. Cl.[6] ..... B41J 2/355

[52] U.S. Cl. ..... 347/183; 347/172

[58] Field of Search ..... 347/175, 183, 347/172, 211; 358/503, 521, 298

[56] References Cited

U.S. PATENT DOCUMENTS

| | | | |
|---|---|---|---|
| 4,590,491 | 5/1986 | Hori et al. | 347/211 |
| 4,734,704 | 3/1988 | Mizutani et al. | 346/76 PH |
| 5,075,698 | 12/1991 | Aoki et al. | 347/183 |
| 5,363,125 | 11/1994 | Inui et al. | 347/183 |
| 5,398,050 | 3/1995 | Sato | 347/172 |

FOREIGN PATENT DOCUMENTS

| | | |
|---|---|---|
| 3-221468 | 1/1990 | Japan . |
| 3-288688 | 4/1990 | Japan . |
| 4-28585 | 5/1990 | Japan . |

*Primary Examiner*—N. Le

[57] ABSTRACT

Thermosensitive color recording paper includes a support and three thermosensitive coloring layers formed thereon for yellow, magenta and cyan colors. The uppermost yellow coloring layer has the highest heat sensitivity. The undermost cyan coloring layer has the lowest heat sensitivity. When the yellow or magenta coloring layer is colored at high density, the next-underlying coloring layer is inevitably colored at a small amount. A thermal head has heating elements which are respectively driven by a pulse train constituted of a bias pulse and gradation pulses. The bias pulse raises the temperature up to coloring temperature to record one pixel in each coloring layer. The number of the gradation pulses represents the density of recording on the pixel. The bias pulse is divided into two. The gradation pulses are grouped into two groups. To record the one pixel, the pulse train is generated so as to supply the thermal head with the first subsidiary bias pulse, the first gradation pulse group, the second subsidiary bias pulse, and then the second gradation pulse group, while the recording paper is moved. Although each gradation pulse group is related to a density lower than a desired final density of the pixel, the pixel is recorded to have appearance of such a final density, so as to obtain a well reproduced full-color image on the recording paper.

18 Claims, 7 Drawing Sheets

COLOR THERMAL PRINTING METHOD AND APPARATUS

BACKGROUND OF THE INVENTION

1. Field of the Invention

The present invention relates to a color thermal printing method, and more particularly to an improved color thermal printing method preventing neighboring thermosensitive coloring layers from being colored at the same time.

2. Description Related to the Prior Art

A thermosensitive color recording material has been known, e.g. from U.S. Pat No. 4,734,704, which can directly print a full-color image using a thermal head without using a color ink ribbon. A commonly assigned Japanese patent application, laid open to the public as JP-A 3-288688, discloses another type of a thermosensitive color recording material 7 illustrated in FIG. 10. This material has cyan, magenta, and yellow thermosensitive coloring layers 3, 4, and 5, and a protective layer 6 formed on a support 2 in this order. In this type of the recording material 7, the heat sensitivity of the uppermost yellow coloring layer 5 is highest, and that of the undermost cyan coloring layer 3 is lowest (see FIG. 2).

The cyan coloring layer 3 contains as its main components an electron-donor type dye precursor and an electron-acceptor type compound, and forms a cyan dye when heated. The magenta coloring layer 4 contains a diazonium salt compound having a maximum absorption wavelength of 360±20 nm, for example 365 nm, and a coupler which forms a magenta dye when it is thermally reacted with the diazonium salt compound. When an ultraviolet ray of 365 nm is applied to the magenta coloring layer 4 after thermal printing, the diazonium salt compound is discomposed photochemically and loses a coloring ability. The yellow coloring layer 5 contains a diazonium salt compound having a maximum absorption wavelength of 420±20 nm, for example 420 nm, and a coupler which forms a yellow dye when it is thermally reacted with the diazonium salt compound. When a near-ultraviolet ray of 420 nm is applied to the yellow coloring layer 5, it is fixed and loses a coloring capacity.

When recording a full-color image on the above-described recording material 7, a thermal head having a plurality of heating elements arranged in a line is used. First, the yellow coloring layer 5, disposed to be the uppermost of the coloring layers, is applied to thermal recording, in course of relative movement between the thermal head and the recording material 7. During the thermal recording, each heating element of the thermal head is supplied with a bias pulse having a relatively large width for heating the recording material 7 nearly up to the coloring temperature and then a number of image pulses having a smaller width for changing the power-on time depending upon the pixel optical density of an original image and forming color pixels having a desired optical density. This method of driving heating elements is described, for example, in commonly assigned Japanese patent application laid open to the public as JP-A 3-221468. After thermally recording a yellow image, a near-ultraviolet ray of 420 nm is applied to optically fix the yellow image. Next, the magenta coloring layer 4, or the second uppermost layer, is applied to thermal recording by using a higher heat energy than that applied for the yellow coloring layer 5. Thereafter, the magenta image is optically fixed by exposure to an ultraviolet ray of 365 nm.

Lastly, the cyan coloring layer 3, or the undermost layer, is applied to thermal recording by using a highest heat energy.

The recording material 7 has intermediate layers formed between the coloring layers, though they are not shown in FIG. 10. When the respective intermediate layer is increased in thickness, the overlap between coloring characteristic curves can be avoided, even through there is a decrease in the heat sensitivity posing a problem in practical use. Such a recording material having no overlap of the characteristic curves has been proposed, for example, in JP-A 4-28585. With this recording material, first, the yellow coloring layer (the uppermost) is heated by a thermal head, the heat allowing only the yellow coloring layer to develop color, to react the diazonium salt compound contained in the layer with the coupler and form a yellow dye. After the yellow coloring layer is heated and fixed, the magenta coloring layer (the second uppermost) is heated by the thermal head, the heat allowing only the magenta coloring layer to develop color and not allowing the cyan coloring layer (the undermost) to develop color. After the magenta coloring layer is fixed, the cyan coloring layer is heated to develop cyan color. The half tone image for yellow, magenta, and cyan can be independently recorded without color mixture by driving the thermal head under the following conditions:

Thermal head: printing energy of 0.5 W/dot (manufactured by Kyocera Corporation);

Pixel density: 8 lines/mm, namely 16 dots/mm;

Thermal head driving pulse: having a constant voltage and a power-on time changing by 0.2 ms pitch depending on the tone level:

Yellow: 0.4 to 2.0 ms;

Magenta: 2.4 to 4.0 ms; and

Cyan: 4.4 to 6.0 ms.

To use different recording materials in which coloring characteristic curves of coloring layers are overlapped between the colors, it is required not only to record density of each color as high as desired but also suppressing development of the color of which the characteristic curve is overlapped with that of the color to be developed. To be precise, the high density range of the yellow coloring layer 5 (in a zone EA in the graph of FIG. 2) overlaps with the low density range of the magenta coloring layer 4. Therefore, when a high density image for yellow is recorded, the magenta coloring layer 4 develops color by the heat energy applied for coloring the yellow image to cause color mixture of magenta with yellow as illustrated in FIG. 2, which results in failure in reproducing the color hue with fidelity. The high density range of the magenta coloring layer 4 (in a zone EB in the graph of FIG. 2) overlaps with the low density range of the cyan coloring layer 3. When a high density for magenta is recorded, the cyan coloring layer 3 develops color by the heat for coloring magenta to cause color mixture of cyan with magenta, which results in failure in color reproduction.

In view of this, for the thermal recording of the yellow and magenta coloring layers 5 and 4, the heat energy in use could be limited in a predetermined smaller range than the smallest energy which develops color of a coloring layer under-lying the relevant coloring layer. However, this improvement in turn would make it impossible to reproducing high density in images. There would take place a further problem in that, as illustrated in FIG. 11, a portion 8 of a coloring layer within the one pixel 9, as colored by a single heat element as a color dot, would be conspicuously smaller than the pixel 9, and apparently surrounded by blank ground.

SUMMARY OF THE INVENTION

In view of the foregoing problems, an object of the present invention is to provide a color thermal printing method capable of preventing an underlying thermosensitive coloring layer from developing color by a surplus heat energy applied to an overlying thermosensitive coloring layer for developing color of a high density.

Another object of the present invention is to provide a color thermal printing method capable of printing images at a high speed.

In order to achieve the above and other objects and advantages of this invention, a thermosensitive color recording material includes a support and at least first to third thermosensitive coloring layers formed thereon. The first coloring layer has lower heat sensitivity than the second coloring layer. The second coloring layer has lower sensitivity than the third coloring layer. The recording material has such coloring characteristic that when the third coloring layer is colored at high density in driving a thermal head by a plurality of pulses, the second coloring layer is inevitably colored at a small amount. Otherwise or additionally, when the second coloring layer is colored at high density in driving the thermal head by a plurality of pulses after fixation of the third coloring layer, the first coloring layer is inevitably colored at a small amount. The thermal head has a plurality of heating elements, each of which is driven by a pulse train in combination of a bias pulse for raising temperature substantially up to coloring temperature in order to record one pixel in a selected one of the coloring layers, and gradation pulses of which a number represents density of recording the pixel. The pulse train is divided into N pulse sub-trains, each of which includes one of N subsidiary bias pulses into which the bias pulse is divided at an equal width, and one of N gradation pulse groups into which the gradation pulses are divided substantially equally, and adapted to recording density lower than a desired final density of the pixel. The thermal head is supplied with the N pulse sub-trains while the recording material is moved relative to the thermal head by an amount of the one pixel, in order to record the one pixel in the coloring layer. An underlying thermosensitive coloring layer can be prevented from developing color by a surplus heat energy applied to an overlying thermosensitive coloring layer for developing color of a high density.

In an alternative solution, the objects of the present invention might be achieved by a construction in which each heating element would emit heat at a temperature peaking for M times, and MN gradation pulses would be generated for reproduction gradation in N grades. To keep the heat energy equal to that in the conventional method, the gradation pulses would have a width 1/M as great as the conventional method. To print images as fast as the conventional method, such a construction would require the signal processing M times as quickly as the conventional method. However, such an alternative construction would be difficult to practice, as high precision and high speed would be required at the same time. It would be otherwise conceived that voltage applied to the thermal head would be lowered and that gradation pulses would have a greater width. This, however, would be unadvantageous because the time for recording one line would be too long.

In the present invention, no difficulty takes place regarding the precision of gradation pulses and the speed in signal processing. Images can be printed at high speed with great ease.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
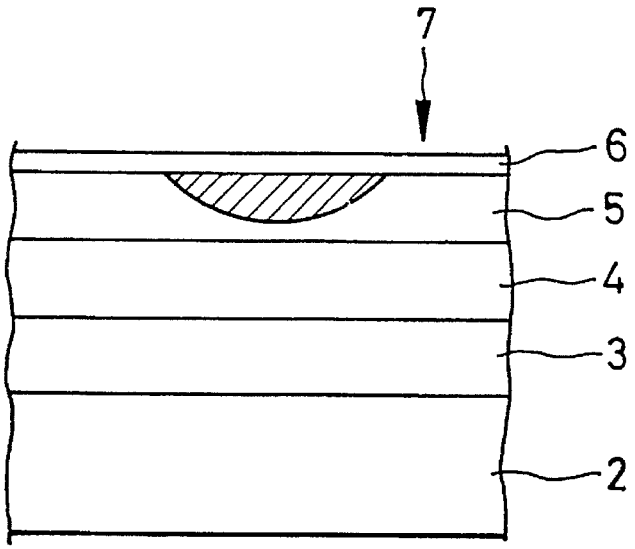
FIG. 1 is an explanatory view of the layer structure of a color thermosensitive recording material used to practice the color thermal printing method according to the present invention.
Figure 2:
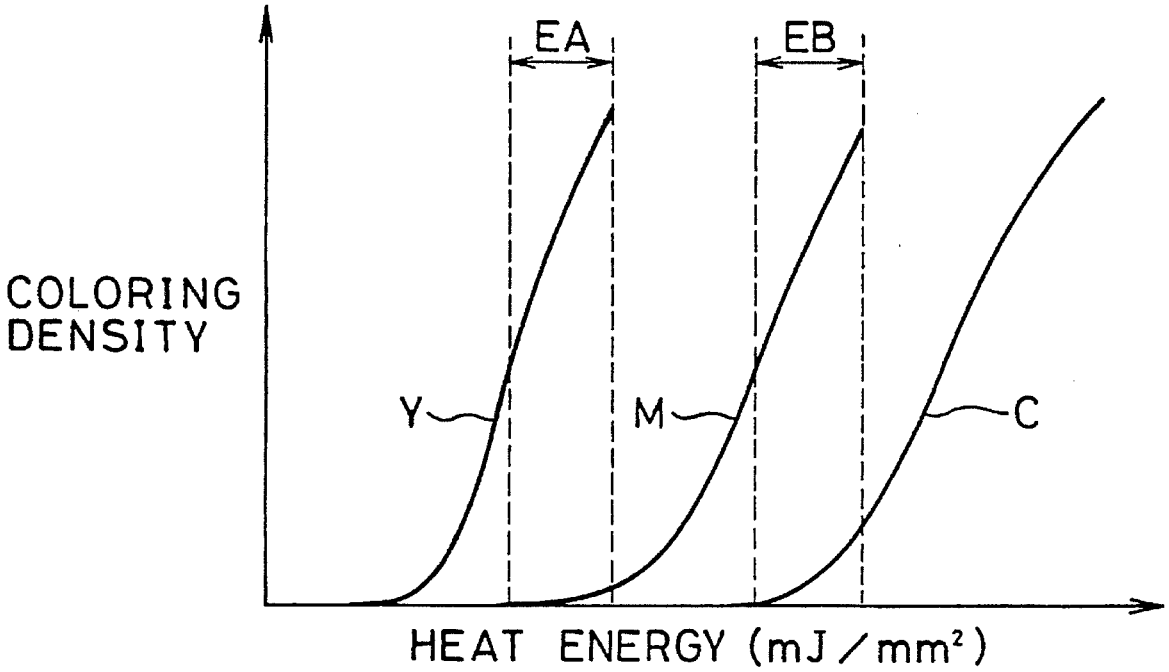
FIG. 2 is a graph illustrating coloring characteristics of each thermosensitive coloring layer illustrated in FIG. 1.

In FIG. 1, thermosensitive color recording material 7 has cyan, magenta, and yellow thermosensitive coloring layers 3, 4, and 5, and a protective layer 6 formed on a support 2 in this order. In the recording material 7, the heat sensitivity of the uppermost yellow coloring layer 5 is highest, and that of the undermost cyan coloring layer 3 is lowest, as illustrated in FIG. 2.

Figure 3:
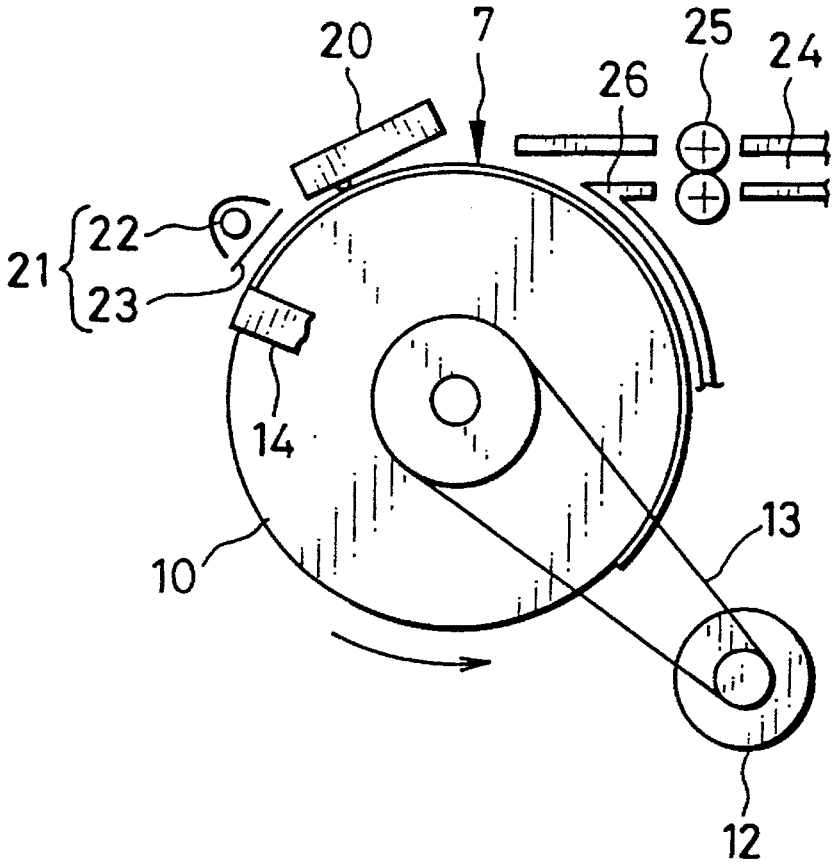
FIG. 3 is a schematic diagram of a color thermal printer used to practice the color thermal printing method according to the present invention.

In FIG. 3, a platen drum 10 carries the recording paper 7 on the periphery thereof, and is rotated by a pulse motor 12 connected via a belt 13 in a direction of an arrow during thermal recording. The platen drum 10 is provided with a clamper 14 which secures the recording paper 7 to the platen drum 10 at least at a portion, for example, at the leading end of the recording paper 7. The platen drum 10 is rotated at a substantially uniform velocity while the pulse motor 12 rotates stepwise, because of transmission of rotation via the belt 13.

Figure 4:
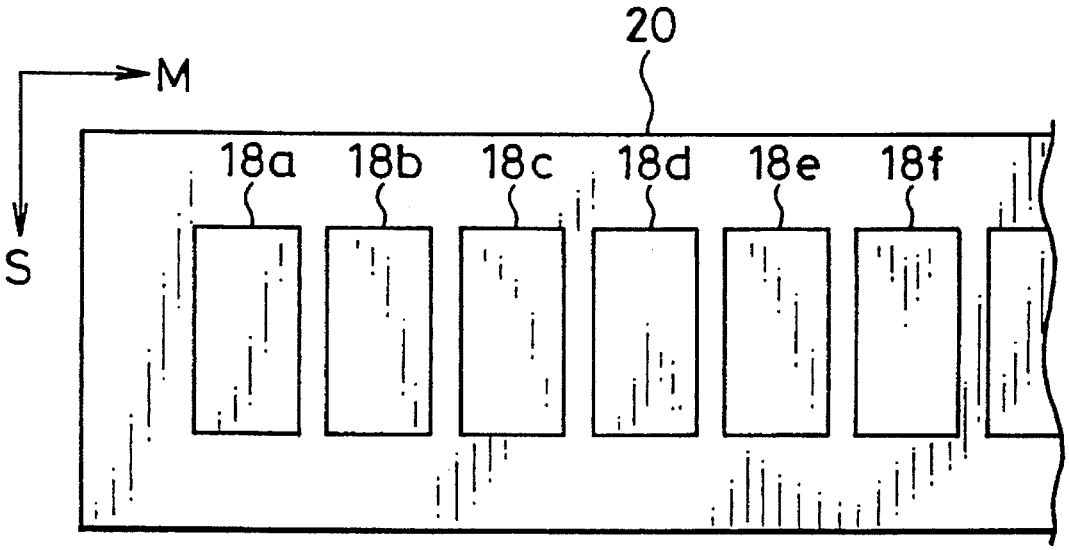
FIG. 4 is an explanatory view of a thermal head.
Figure 5:
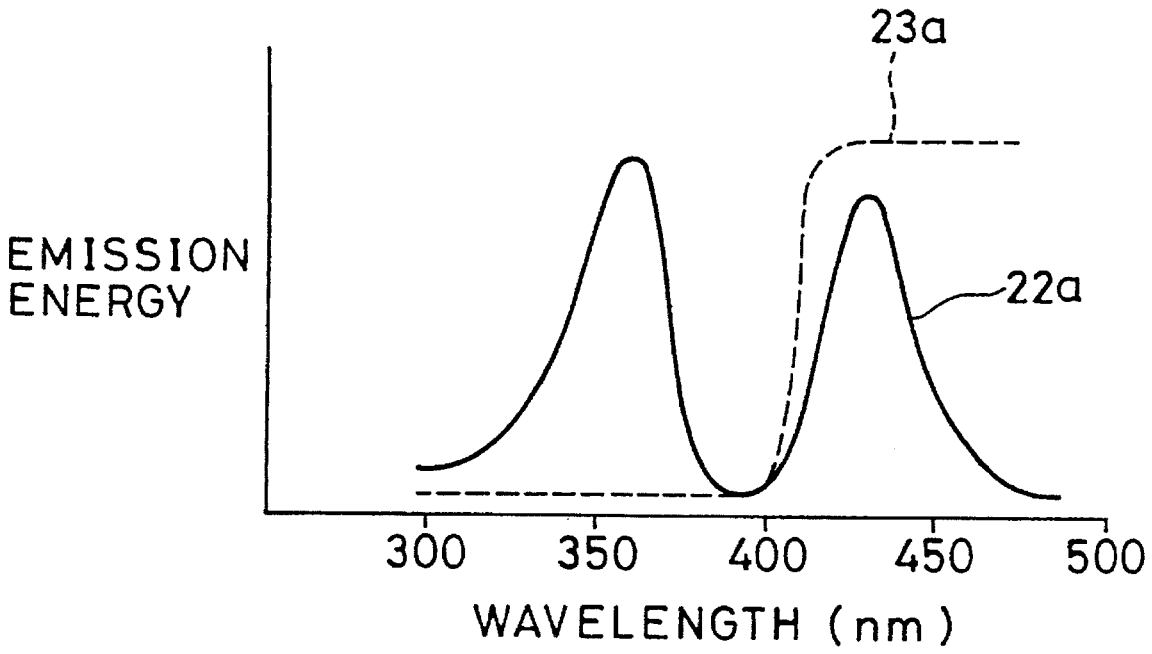
FIG. 5 is a graph illustrating the characteristics of an ultraviolet lamp and a sharp-cut filter of a fixing device.
Figure 6:
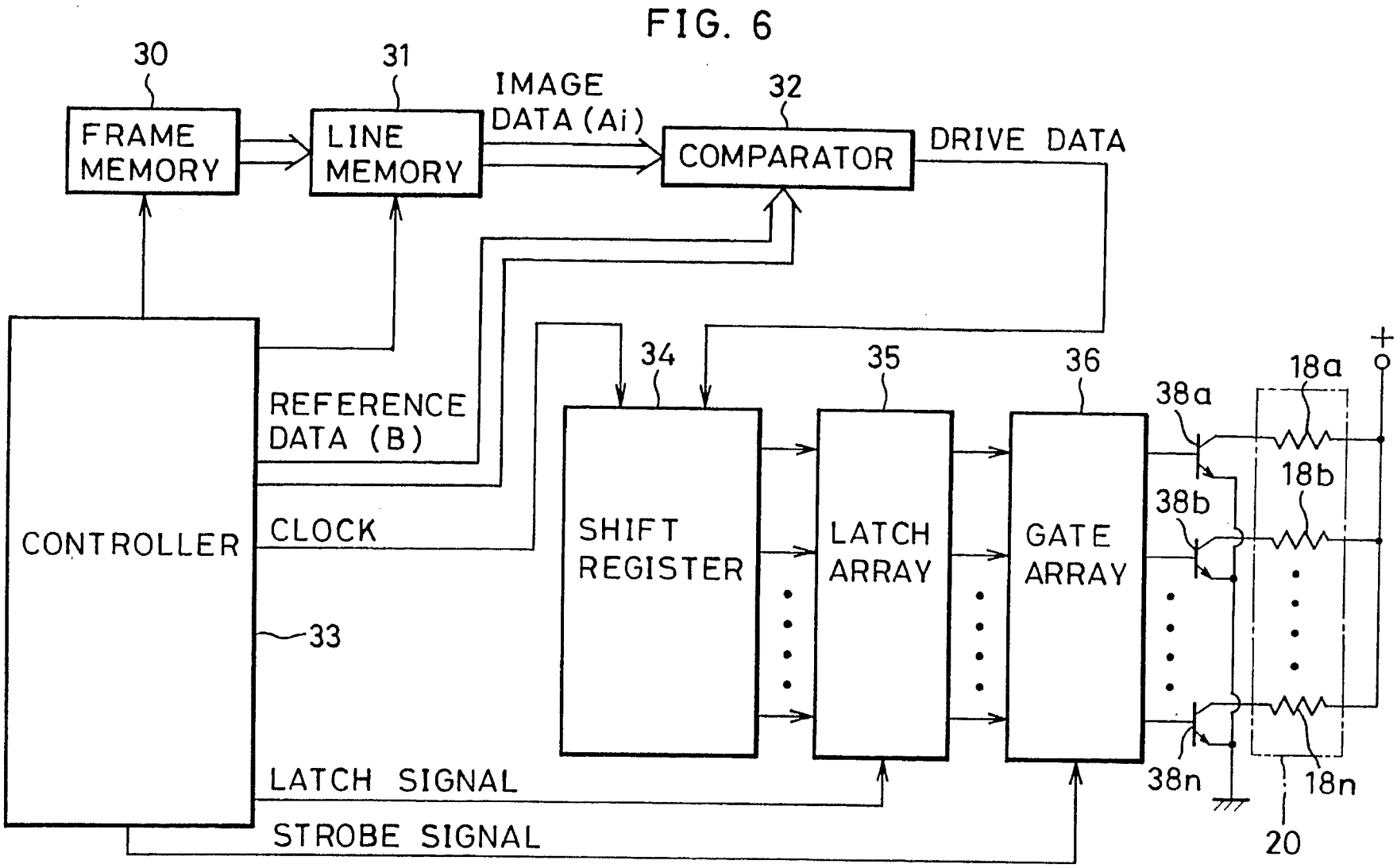
FIG. 6 is a block diagram illustrating relevant circuitry of the color thermal printer.

Above the periphery of the platen drum 10 is disposed a thermal head 20 having a plurality of heating elements **18*a* to 18*n* as illustrated in FIGS. 4 and 6 and arranged in a line in a main scanning direction M, which is perpendicular to a sub-scanning direction S in which the platen drum 10 rotates. Each heating element is rectangular and long in the sub-scanning direction. A fixing device 21 is disposed and includes a stick-shaped ultraviolet lamp 22 having two emission centers at wavelengths near to 365 nm and 420 nm, as indicated by a solid line curve 22***a* in FIG. 5, and a sharp-cut filter 23 having a transmission curve 23*a* as indicated by a dashed line in FIG. 5. The sharp-cut filter 23 is retractably inserted into the front of the ultraviolet lamp 22 by means of a solenoid or another device, so as to transmit near-ultraviolet rays having a wave-length range over about 400 nm, while cutting off near-ultraviolet rays with a range below about 400 nm. A paper feed path 24 is provided with a pair of feed rollers 25 through which the recording paper 7 is fed to the platen drum 10 and, thereafter, is ejected from the platen drum 10. On the side near to the platen drum 10, a peeling claw 26 is provided in the paper feed path 24 for peeling off the trailing end of the recording paper 7 from the platen drum 10 and guiding the recording paper 7 into the paper feed path 24 in ejecting the recording paper 7. In this embodiment, although the paper feed path 24 is commonly used for paper feeding and ejecting, it is possible to provide a paper ejection path separately from a paper feed path.

FIG. 6 illustrates circuitry for driving the thermal head. In a frame memory 30, image data of a single frame is written. Let j designate a position of a pixel in the sub-scanning direction and i designate a position of the pixel in the main scanning direction. To record the frame thermally, image data of a first line of the frame where j=1 is read out of the frame memory 30, and written into a line memory 31. n bodies of image data Ai are written in the line memory 31, and then serially read out and sent into a comparator 32. The comparator 32 compares the image data Ai of each pixel with reference data B generated from a controller 33 in a four-bit form. If Ai is equal to or greater than B, then the comparator 32 generates drive data of "1". If Ai is smaller than B, then the comparator 32 generates drive data of "zero".

Figure 7:
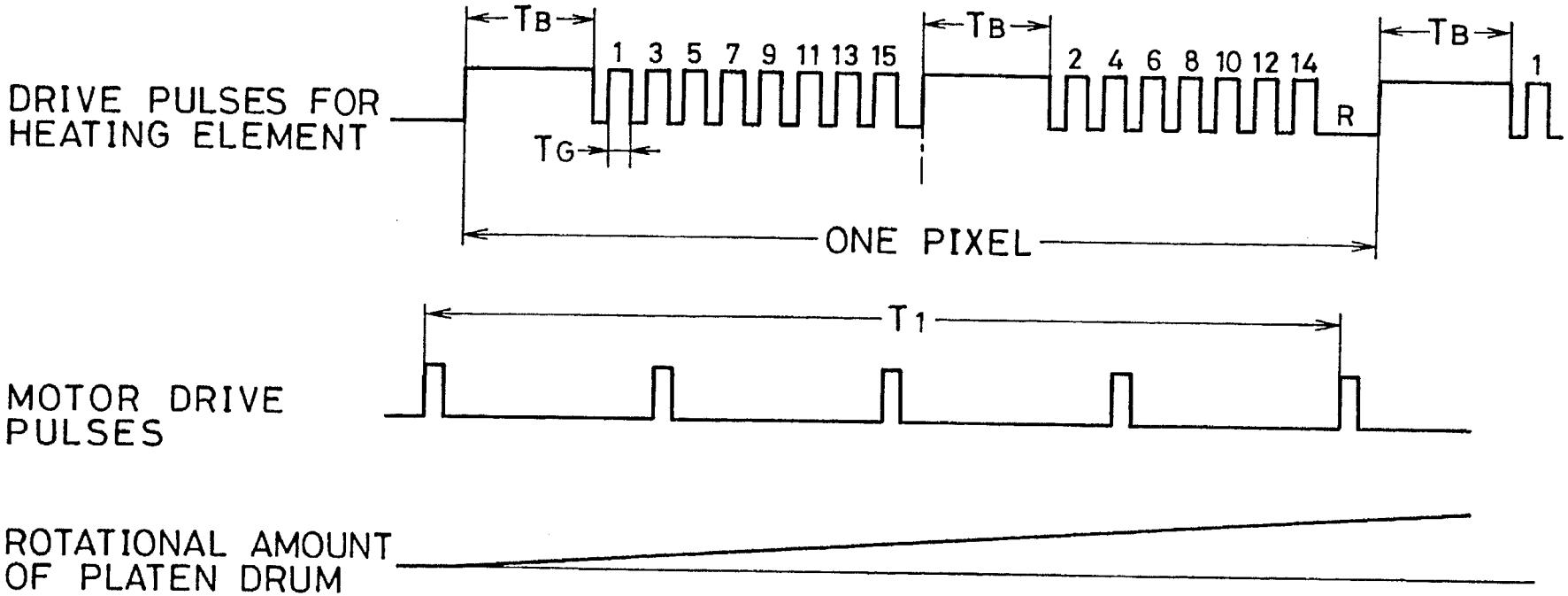
FIG. 7 is a timing chart illustrating waveforms of signals at a head drive unit and a waveform of heating a heating element.

Let the printer reproduce images by means of 16 grades of gradation. As illustrated in FIG. 7, the controller 33, in the course of four pulses for driving the pulse motor 12 and corresponding rotational movement of the platen drum 10 by one line, generates the reference data B of zero to 15 while separating the data into odd-numbered data and even-numbered data: in the order of "0, 1, 3, 5, 7, 9, 11, 13, 15, 0, 2, 4, 6, 8, 10, 12 and 14", in which the data "0" is generated twice. When the controller 33 at first sends the reference data "0" to the comparator 32, the comparator 32 compares the reference data "0" with the image data A1 of the first pixel where i=1, and generates either drive data of 1 or 0. The comparator 32 next compares the reference data "0" with the image data A2 of the second pixel where i=2, and generates either drive data. Comparing operation follows similarly for the image data A3 to An.

The comparator 32 generates the serial drive data for the one line and sends it into a shift register 34. The serial drive data is shifted in the shift register 34 in response to clock generated by the controller 33, and converted into n bodies of parallel drive data. The n drive data are sent into a latch array 35 constituted of n latch circuits. The controller 33 checks the supply of strobe signals into a gate array 36. If no strobe signals are being supplied into the gate array 36, then the controller 33 starts a timer incorporated in the controller 33. At the same time as this, the controller 33 generates a latch signal so as to cause the n latch circuits to latch the respective drive data.

The latch array 35 is connected to the gate array 36 constituted of n gates. The controller 33, after generation of the latch signal, starts generating the strobe signals, and sends them into the gate array 36. If the reference data B represents what is different from zero, then the controller 33 stops generating the strobe signal in response to the lapse of a powering unit period $T_G$ for reproducing the gradation, according to the timer. If the reference data B represents zero, then the controller 33 stops generating the strobe signal in response to the lapse of a powering period $T_B$ for bias heating of each heating element, according to the timer, where $T_B > T_G$. The period $T_B$ is a width of a subsidiary bias pulse, determined to be substantially a half of the time of the bias heating required for one line, and takes place twice during the thermal recording of one line to power the heating element. The unit period $T_G$ is a width of one gradation pulse, is used for the gradation-reproducing heating, and corresponds to one grade of gradation.

When the drive data is "1", each gate in the gate array 36 stands open during receiving the strobe signal. When the drive data is "0", each gate stands closed. The gates are connected to transistors 38*a* to 38*n* serially. Only transistors connected to open gates are turned on. The transistors 38*a* to 38*n* are adapted individually to driving the heating elements 18*a* to 18*n* to generate heat.

Upon the powering after the completion of comparison of the n bodies of the image data Ai constituting the one line, the controller 33 generates the following reference data B of "1" and sends it into the comparator 32. The comparator 32 compares the reference data "1" serially with the image data Ai of the n pixels to generate serial drive data, which drive the heating elements 18*a* to 18*n* respectively. Similar comparison follows with the reference data "3" and up to "15", with an increment of 2. The controller 33 next generates the reference data "0", "2" and up to "14", with an increment of 2. The generation of the n bodies of the image data Ai are respectively compared for 16 times, and converted into 16 bodies of serial drive data. Afterwards, image data of a second line where j=2 is written into the line memory 32. Operation similar to the foregoing is repeated.

Note that T1 illustrated in FIG. 7 represents a recording cycle allocated for recording one pixel, which is set shorter for the coloring layer having a higher heat sensitivity. R represents cooling period which is variable depending on the gradation level between the coloring layers, and can be set shorter for the coloring layer having a higher heat sensitivity.

The operation of the color thermal printer will be described. Before paper feeding, the platen drum 10 has such a rotational position that the clamper 14 is placed with its arm portions oriented upright in FIG. 3, at the exit of the paper feed path 24. The pair of feed rollers 25 nip and feed the recording paper 7 toward the platen drum 10 while the recording paper 7 is supplied from a cassette (not shown). The feed rollers 25 stop rotating when the leading end of the recording paper 7 is placed between the platen drum 10 and the clamper 14. Thereafter, the leading end of the recording paper 7 is clamped. After clamping the recording paper 7, the platen drum 10 and the feed rollers 25 start rotating, so that the recording paper 7 is wound on the periphery of the platen drum 10.

While the platen drum 10 is rotated continuously through the cushioning effect of the belt 13, the leading edge of an imaging area on the recording material 7 reaches the thermal head 20. The thermal recording with the yellow coloring layer 5 is started. At first, the n bodies of the image data Ai for the first line are read out of the frame memory 30, and are written into the line memory 31. The image data Ai for each pixel is read out of the line memory 31, sent into the comparator 32, and compared with the reference data B generated by the controller 33. If the image data Ai is equal to or greater than the reference data B, then the comparator 32 generates an output "1". Otherwise, the comparator 32 generates an output of "0". The output after the comparison is sent into the shift register 34 as serial drive data, and converted into the parallel drive data, which are latched by the latch array 35 in synchronism with the latch signal. Gates which receive the drive data "1" in the gate array 36 are opened only during the supply of the strobe signals, so as to turn on the transistors associated with the opened gates. The transistors 38*a* to 38*n* selectively power the heating elements 18*a* to 18*n* in response to the drive data.

Figure 8:
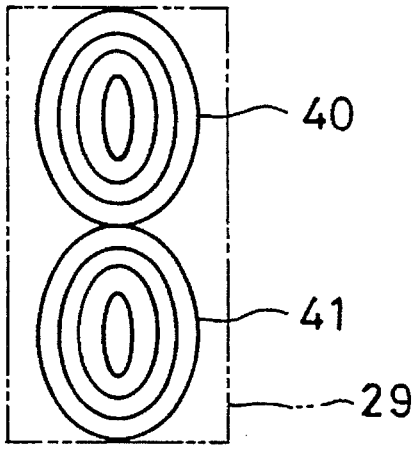
FIG. 8 is an explanatory view illustrating a state of pixel after thermal recording in accordance with the present invention.

The respective heating elements 18*a* to 18*n* are powered by the drive pulses in FIG. 7, in the sequence of a subsidiary bias pulse, a half of the gradation pulses in series, a subsidiary bias pulse, and then the remaining half of the gradation pulses; namely of two pulse sub-trains. Temperature of heating is peaked twice for the recording of one line in the course of the continuous rotation of the platen drum 10. It follows that, as illustrated in FIG. 8, two portions 40 and 41 of the yellow coloring layer 5 within the one pixel are colored in the orientation in the sub-scanning direction. Heat energy applied to the colored portions 40 and 41 is in a range below energy enough to develop color of the magenta coloring layer 5, so that only the yellow coloring layer 5 is colored as illustrated in FIG. 1. Although the density of the colored portions 40 and 41 is lower than the density of the corresponding image data, combination of the colored portions 40 and 41 reproduces appearance of the original image with fidelity when observed from a proper distance, because the colored portions 40 and 41 are located so closely. Upon completion of the thermal recording of the pixels on the first line, the platen drum 10 is rotated by an amount of the one line. Similar operation to the above follows and is repeated, to record pixels on a plurality of lines.

During the yellow thermal recording, the part of the recording paper 7 on which the yellow image has been recorded is moved to face to the fixing device 21, and the yellow coloring layer 5 is fixed. At that time, because the sharp-cut filter 23 is placed in front of the ultraviolet lamp 22, the recording paper 7 is exposed to near-ultraviolet rays having a wavelength range about 420 nm, so that the diazonium salt compound remaining in the yellow coloring layer 5 is decomposed photochemically to lose the coloring capacity thereof.

When the platen drum 10 makes one revolution to place under the thermal head 20 the leading edge of the recording area of the recording paper 7 again, the thermal head 20 performs the thermal recording of the magenta coloring layer 4 in the manner similar to the thermal recording of the yellow coloring layer 5. At this time, the yellow coloring layer 5 will not be colored because it is already fixed.

When the recording paper 7 reaches the fixing device 21 during the magenta thermal recording, it is fixed. In this case, because the sharp-cut filter 23 is removed from the front of the ultraviolet lamp 22, all electromagnetic waves radiated from the lamp 22 are applied to the recording paper 7. Of the electromagnetic waves, the ultraviolet rays near 365 nm optically fix the magenta coloring layer 4. In this manner, one pixel is recorded thermally for the magenta coloring layer 4 while there take place two peaks in temperature of the heating element 18*a*. The thermal recording of the magenta coloring layer 4 allows the layer 4 to be colored without coloring the underlying cyan coloring layer 3, similar to the case of the yellow thermal recording.

When the platen drum 10 further makes one revolution so as to place the recording area under the thermal head 20, the thermal recording of a cyan image starts. The thermal head 20 applies the heat energy corresponding to the coloring density to the recording paper 7, for recording the cyan image line by line in the cyan coloring layer 3. Although the color mixture will not occur in the cyan coloring layer 3, a problem in that cyan colored dots would be surrounded by conspicuous blank ground requires prevention. The thermal recording is performed in a similar manner to the yellow thermal recording. No light fixation will be carried out and the fixing device 21 is turned off.

After recording the yellow, magenta, and cyan images, the platen drum 10 and the pair of feed rollers 25 are rotated in reverse. Thereby, the trailing end of the recording paper 7 is guided by the peeling claw 26 into the paper feed path 24, and is nipped by the feed rollers 25. Thereafter when the platen drum 10 reaches the initial position at which the clamper 14 is placed at the exit of the paper feed path 24, the platen drum 10 stops rotating. The clamper 14 is moved to the release position, so that the leading end of the recording paper 7 is released from the clamper 14, and is ejected from the platen drum 10 through the paper feed path 24 onto a receptacle tray.

Figure 9:
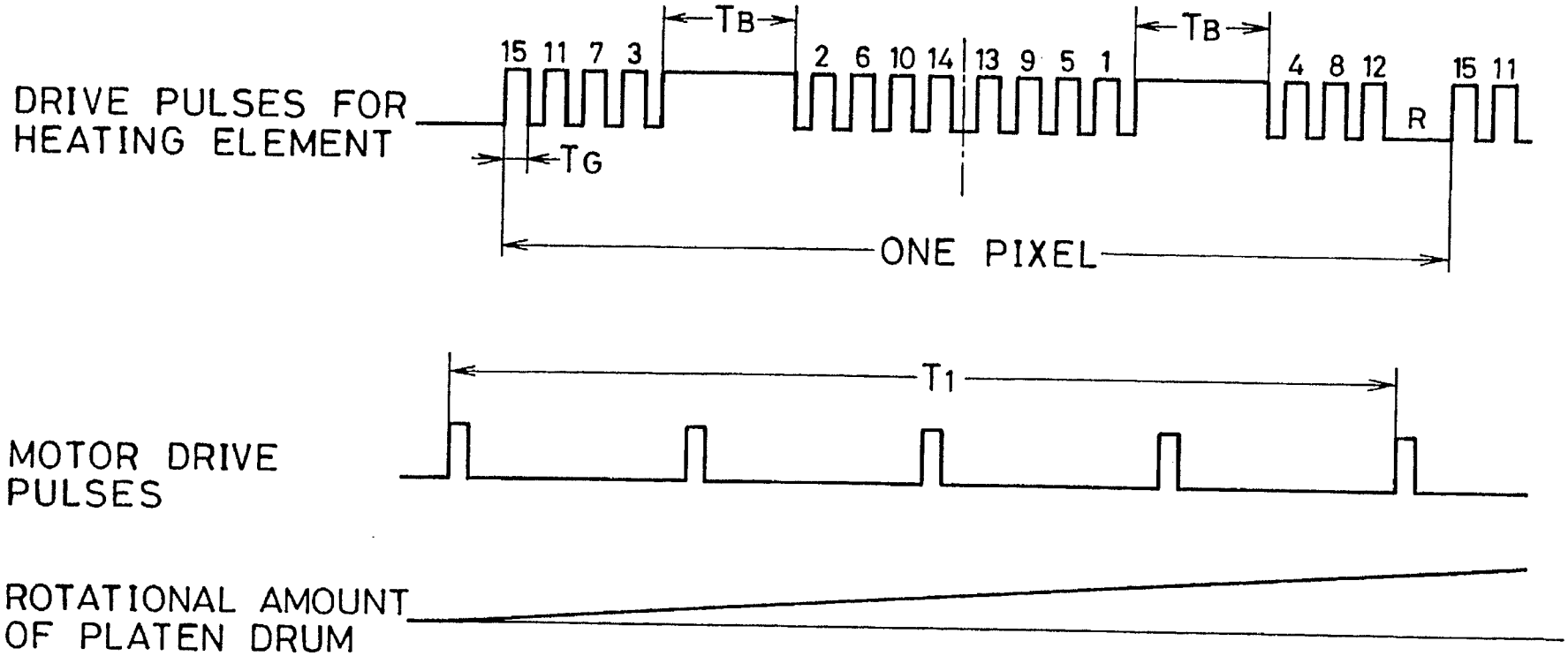
FIG. 9 is a timing chart illustrating waveforms of signals at a head drive unit and a waveform illustrating the state of heating a heating element.
Figure 10:
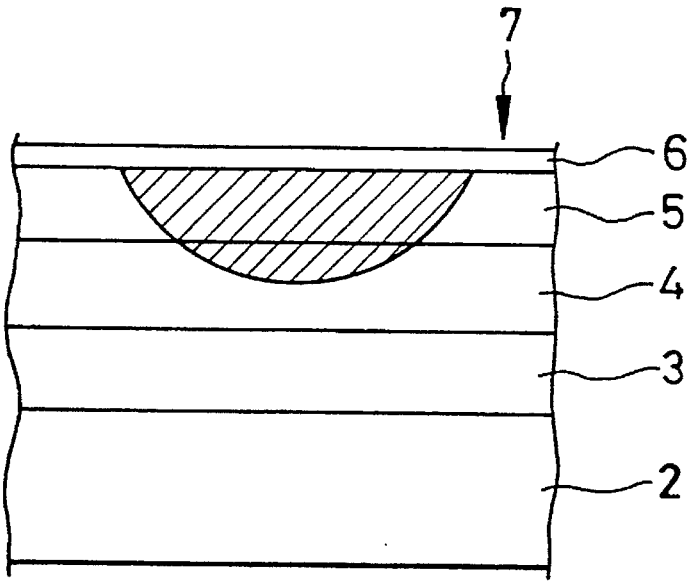
FIG. 10 (PRIOR ART)
FIG. 10 is an explanatory view of the layer structure of the recording material used to practice the color thermal printing method according to the prior art.
Figure 11:
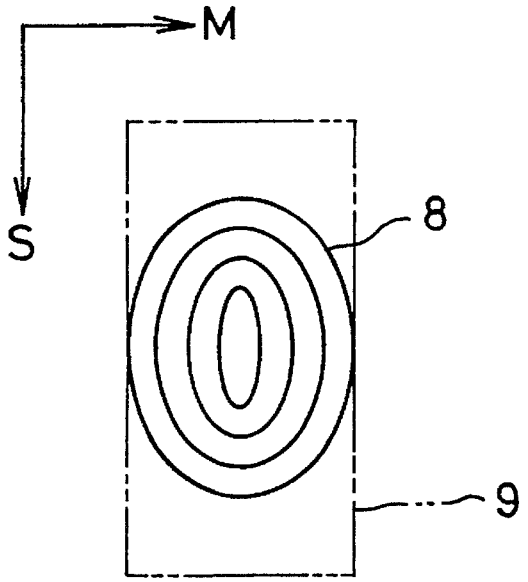
FIG. 11 (PRIOR ART)
FIG. 11 is an explanatory view illustrating a state of pixel after thermal recording in accordance with the prior art.

FIG. 9 illustrates another preferred embodiment in which each of the two subsidiary bias pulses is supplied in the middle of a group of gradation pulses. The four-bit reference data B from 0 to 15 are generated in the order of "15, 11, 7, 3, 0, 2, 6, 10, 14, 13, 9, 5, 1, 0, 4, 8, and 12". To output the reference data B, the comparator 32 starts the operation at "B=15", performs subtraction of "B=B–4", i.e. decrementally by 4, and when "B=–1", sets "B=0", next sets "B=2", and performs addition of "B=B+4" incrementally by 4, until "B=14". When in the middle of the one line, the comparator 32 performs subtraction of "B=B–4" decrementally by 4, and when "B=–3", sets "B=0", and performs addition of "B=B+4" incrementally by 4, until "B=12". Even when gradation varies among pixels, the time points in the center of the bias pulses having the powering period $T_B$ are constantly at the lapse of T1 /4 and T1·¾ where T1 is the duration of one recording cycle for one pixel. It follows that centers of the dots recorded on the recording paper 7 are aligned in the main scanning direction, and that the novel printing method is advantageous in having no deviation in registration of colors.

In the above embodiments, the respective heating elements 18*a* to 18*n* in the recording of the yellow coloring layer and the magenta coloring layer are powered in such a manner that temperature of heating is peaked twice for the recording within one pixel. Alternatively, the heating elements 18*a* to 18*n* during recording may be so powered that temperature of heating is peaked for three times, or more times, for the recording within one pixel. The multiple-peaking thermal recording is performed for the yellow and magenta coloring layers, or for all the three coloring layers, in the above embodiments. However, the multiple-peaking thermal recording may be performed only for the yellow coloring layer which has the greatest effect to color mixture.

The heat energy necessary for coloring the undermost cyan coloring layer 3 has such a large value that cannot be applied to the recording paper under a normally preserving condition. Therefore, the cyan coloring layer 3 is not given a capacity of being fixed. However, a capacity of being fixed may be given to the cyan coloring layer 3 if necessary. Furthermore, although the above described embodiments only relate to a line printer in which a plurality of heating elements are arranged in the main scanning direction M, and the recording paper is moved linearly relative to the thermal head in the sub-scanning direction S (see FIG. 4), the present invention is applicable to serial printers in which pixels are serially printed by a two-dimensional movement of the recording paper relative to the thermal head. Additionally, instead of the platen drum, a paper feed path provided with a plurality of rollers may be used to reciprocally move the recording paper along this paper feed path.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A color thermal recording method for recording full-color images on thermosensitive color recording material by use of a thermal head, said recording material comprising a support and at least first to third thermosensitive color layers formed thereon in order, said first coloring layer having lower heat sensitivity than said second coloring layer, said second coloring layer having lower heat sensitivity than said third coloring layer, said thermal head having a plurality of heating elements, each of which is driven by a pulse train in combination of a bias pulse for raising temperature substantially up to coloring temperature in order to record one pixel in a selected one of said color layers, and gradation pulses, a number of which represents density of recording on said pixel, said recording method comprising steps of:

dividing said pulse train into N pulse sub-trains, each of which comprises one of N subsidiary bias pulses into which said bias pulse is divided at an equal width, and one of N gradation pulse groups into which said gradation pulses are divided substantially equally, each of said pulse sub-trains resulting in a recording density lower than a desired final density of said pixel;

supplying said thermal head with said N pulse sub-trains said recording material is moved relative to said thermal head by an amount of said one pixel, in order to record said one pixel in said selected one of said coloring layers; and wherein, in a beginning of each of said pulse sub-trains, a first half of said gradation pulse group, then generating said subsidiary bias pulse, and, finally, generating a second half of said gradation pulse group is generated.

2. A color thermal recording method as defined in claim 1, wherein said pulse train is divided in accordance with a period of thermal recording of at least one of said second and said third coloring layers.

3. A color thermal recording method as defined in claim 2, wherein said pulse train is divided further in accordance with a period of thermal recording of said first coloring layer.

4. A color thermal recording method as defined in claim 1, wherein said first coloring layer contains electron-donor type dye precursor and electron-acceptor type compound as main components, said second coloring layer contains first diazonium salt compound having a maximum absorption wavelength of 360±20 nm and first coupler which develops color when said first coupler is thermally reacted with said first diazonium salt compound, and said third coloring layer contains second diazonium salt compound having a maximum absorption wavelength of 420±20 nm and second coupler which develops color when said second coupler is thermally reacted with said second diazonium salt compound.

5. A color thermal recording method as defined in claim 4, wherein said heating elements are aligned in a direction perpendicular to movement of said recording material.

6. A color thermal recording method as defined in claim 5, wherein each of said heating elements is shaped long in a direction of said movement of said recording material.

7. A color thermal recording method as defined in claim 5, wherein in a beginning of each of said pulse sub-trains, said subsidiary bias pulse is generated, and afterwards, said gradation pulse group is generated.

8. A color thermal recording method as defined in claim 7, wherein said first coloring layer is a cyan coloring layer, said second coloring layer is a magenta coloring layer, and said third coloring layer is a yellow coloring layer.

9. A color thermal recording method as defined in claim 8, wherein N=2.

10. A color thermal recording method as defined in claim 1, further comprising repeating said dividing step and supplying step for another one of said coloring layers.

11. A color thermal recording method as defined in claim 10, further comprising, before said repeating, the steps of:

fixing the selected one of said coloring layers; and moving the one pixel back into a recording position.

12. A color thermal printer for recording full color images on thermosensitive color recording material comprising a support and at least first to third thermosensitive coloring layers formed thereon in order, said first coloring layer having lower heat sensitivity than said second coloring layer, and said second coloring layer having lower heat sensitivity than said third coloring layer, said color thermal recorder comprising:

a thermal head having a plurality of heating elements;

a conveyor which conveys the recording material past said thermal head;

means for dividing a pulse train comprising a bias pulse for raising a temperature of a heating element substantially up to a coloring temperature in order to record one pixel in a selected one of said coloring layers and gradation pulses, a number of said gradation pulses representing density of recording on the pixel, into N pulse sub-trains, each of N pulse sub-trains comprising one of N subsidiary bias pulses into which said bias pulse is divided at an equal width and one of N gradation pulse groups into which said gradation pulses are divided substantially equally, each of said pulse sub-trains resulting in a recording density which is lower than a desired final density of the pixel;

means for supplying said thermal head with said N pulse sub-trains while said conveyor moves the recording material relative to said thermal head by an amount of the one pixel, in order to record the one pixel in said selected one of said coloring layers; and means for sequentially generating a first half of said gradation pulse sub-trains in a beginning of each of said pulse sub-trains, said subsidiary bias pulse, and, finally, a second half of said gradation pulse group.

13. A color thermal printer as defined in claim 12, wherein said first coloring layer contains electron-donor type dye precursor and electron-acceptor type compound as main components, said second coloring layer contains first diazonium salt compound having a maximum absorption wavelength of 360±20 nm and a first coupler which develops color when said first coupler is thermally reacted with said first diazonium compounds and said third coloring layer contains second diazonium salt compound having a maximum absorption wavelength of 420±20 nm and a second coupler which develops color when said second coupler is thermally reacted with said second diazonium salt compound.

14. A color thermal printer as defined in claim 12, further comprising an ultraviolet lamp, said conveyor moving the material past said ultraviolet lamp after the thermal head, radiation from said ultraviolet lamp fixing a selected one of said layers, and a retractable filter which selectively passes radiation from said ultraviolet lamp to the material.

15. A color thermal printer as defined in claim 14, wherein said retractable filter allows radiation having a wavelength range over about 400 nm to pass from said ultraviolet lamp to the material.

16. A color thermal printer as defined in claim 12, wherein each of said heating elements is elongated in a direction of movement of the recording material.

17. A color thermal printer as defined in claim 12, further comprising:

a comparator which compares image data of a pixel to reference data; and a shift register which receives a comparison result from said comparator, converts said comparison result into parallel drive data, and outputs said parallel drive data to said heating elements.

18. A color thermal printer as defined in claim 12, wherein said pulse train is divided in accordance with a period of thermal recording of at least one of said second and third coloring layers.

* * * * *